US011765810B2

(12) United States Patent
Kisakibaru et al.

(10) Patent No.: US 11,765,810 B2
(45) Date of Patent: Sep. 19, 2023

(54) SOFT X-RAY STATIC ELECTRICITY REMOVAL APPARATUS

(71) Applicant: Cambridge Filter Corporation, Tokyo (JP)

(72) Inventors: Toshiro Kisakibaru, Tokyo (JP); Kouta Ueno, Tokyo (JP); Makoto Yoshida, Tokyo (JP); Nobuyuki Uesugi, Tokyo (JP); Naoji Iida, Tokyo (JP)

(73) Assignee: Cambridge Filter Corporation, Tokyo (JP)

( * ) Notice: Subject to any disclaimer, the term of this patent is extended or adjusted under 35 U.S.C. 154(b) by 147 days.

(21) Appl. No.: 17/611,079

(22) PCT Filed: May 14, 2020

(86) PCT No.: PCT/JP2020/019358

§ 371 (c)(1),
(2) Date: Apr. 26, 2022

(87) PCT Pub. No.: WO2020/230873

PCT Pub. Date: Nov. 19, 2020

(65) Prior Publication Data

US 2022/0256680 A1 Aug. 11, 2022

(30) Foreign Application Priority Data

May 16, 2019 (JP) ..... 2019-092937

(51) Int. Cl.
*H05F 3/06* (2006.01)
*G21F 3/00* (2006.01)

(52) U.S. Cl.
CPC *H05F 3/06* (2013.01); *G21F 3/00* (2013.01)

(58) Field of Classification Search
CPC ..... H05F 3/06; G21F 3/00; H01T 23/00
(Continued)

(56) References Cited

U.S. PATENT DOCUMENTS 5,055,963 A * 10/1991 Partridge ..... H01T 23/00 361/231
2006/0018808 A1* 1/2006 Taylor ..... H01T 23/00 422/186.04
2022/0256680 A1* 8/2022 Kisakibaru ..... G21F 3/00

FOREIGN PATENT DOCUMENTS

CA 2157611 C * 1/2001 ..... H01T 23/00
CN 2879015 Y * 3/2007
(Continued)

OTHER PUBLICATIONS

Japanese Patent Office, International Search Report; International Application No. PCT/JP2020/019358; 2 pages; dated Jul. 21, 2020.
(Continued)

*Primary Examiner* — Dharti H Patel
(74) *Attorney, Agent, or Firm* — Sunstein LLP

(57) ABSTRACT

Provided is a soft X-ray static electricity removal apparatus that has achieved an increase in the amount of ionized air discharged, with a simple structure. A soft X-ray static electricity removal apparatus (1) includes a soft X-ray generation device (90), a container (10), a soft X-ray shielding sheet (20), and an insulating layer (50). The soft X-ray generation device generates soft X-rays (92). The container (10) has an outlet (12) from which ionized air (100) that has been ionized with the soft X-rays flows out. The soft X-ray shielding sheet (20) is used at the outlet of the container and includes a first outer sheet (30), an interlayer sheet (34), and a second outer sheet (40) which are formed of a material opaque to the soft X-rays. The first outer sheet has supply ports (32) for the ionized air formed therein; the interlayer sheet has an ionized air passage (38) formed therein, which includes ionized air inlet openings (36) that communicate with the supply ports; and the second outer sheet has a discharge port (42) formed therein, which communicates with the ionized air passage. The supply ports, the ionized
(Continued)

air passage, and the discharge port communicate with each other to provide an ionized air transmission portion (44). The insulating layer insulates the soft X-ray shielding sheet and the container from each other.

6 Claims, 4 Drawing Sheets

(58) Field of Classification Search
USPC ..... 361/231
See application file for complete search history.

(56) References Cited

FOREIGN PATENT DOCUMENTS

| | | | | |
|---|---|---|---|---|
| DE | 102005000983 | A1 * | 7/2006 | ..... B05B 5/04 |
| DE | 102021117682 | B3 * | 9/2022 | |
| JP | 7-6860 | A | 1/1995 | |
| JP | 2001-257096 | A | 9/2001 | |
| JP | 2007-48539 | A | 2/2007 | |
| WO | WO-03049509 | A1 * | 6/2003 | ..... H01T 23/00 |
| WO | WO 2008/023727 | A1 | 2/2008 | |

OTHER PUBLICATIONS

European Patent Office, Extended European Search Report issued in EP Application No. 20804912.2, dated May 12, 2023, 58 pp.

* cited by examiner

SOFT X-RAY STATIC ELECTRICITY REMOVAL APPARATUS

CROSS-REFERENCE TO RELATED APPLICATIONS

This application is the national phase entry under 35 U.S.C. § 371 of international patent application No. PCT/JP2020/019358 filed May 14, 2020 and claims the benefit of Japanese patent application No. 2019-092937, filed May 16, 2019, the disclosures of which are incorporated herein by reference in their entirety.

TECHNICAL FIELD

The present invention relates to a soft X-ray static electricity removal apparatus. More particularly, it relates to a soft X-ray static electricity removal apparatus that discharges a large amount of ions.

BACKGROUND ART

It has been conventionally known that in a step of processing or handling a semiconductor substrate, a liquid crystal substrate, or an organic EL substrate in a semiconductor, liquid crystal, or organic EL manufacturing process, static electricity is charged on a surface of the substrate and the static electricity causes a trouble that a circuit of the semiconductor substrate, liquid crystal substrate, or organic EL substrate breaks. In addition, electric charging on each substrate also causes a trouble that dust adheres to its surface.

As measures against such troubles, a static electricity removal apparatus that generates ions for preventing electric charging and removing static electricity on a substrate surface is installed in semiconductor, liquid crystal, and organic EL manufacturing apparatuses. As the static electricity removal apparatus, a corona discharge static electricity removal apparatus that ionizes air by high voltage and a soft X-ray static electricity removal apparatus that irradiates air with a soft X ray to ionize air are provided.

In the corona discharge static electricity removal apparatus, particles from an electrode are generated at the time of discharge; while in the soft X-ray static electricity removal apparatus, particles do not occur but leakage of soft X-rays affects human bodies. Thus, both have their respective demerits.

Under the circumstances, a soft X-ray static electricity removal apparatus that takes out only ionized air and does not allow leakage of a soft X-ray to the outside has been developed; however, its structure is complicated. Therefore, one of the inventors has previously proposed a soft X-ray shielding sheet that can prevent leakage of soft X rays from a discharge port with a simple structure by allowing soft X-rays that enter from a supply port to hit a passage at least three or more times before reaching the discharge port so that their travel in a straight line is prevented to make the soft X-rays attenuated or disappear (see Patent Literature 1).

PRIOR-ART PUBLICATION

Patent Literature

Patent Literature 1
International Publication No. WO2008/023727

SUMMARY OF INVENTION

However, as semiconductors and the like are increasingly miniaturized, a demand for further increasing the amount of ionized air discharged and in addition, a demand for adjusting the amount of positive ions/negative ions have been arising. Therefore, it is an object of the present invention to provide a soft X-ray static electricity removal apparatus that achieves a further increase in the amount of ionized air discharged with a simple structure. Furthermore, it is an object of the present invention to provide a soft X-ray static electricity removal apparatus that can adjust the amount of positive ions/negative ions discharged.

Solution to Problem

To solve the above problem, a soft X-ray static electricity removal apparatus 1 according to a first aspect of the present invention includes, as illustrated in FIG. 1 and FIG. 2 for example, a soft X-ray generation device 90, a container 10, a soft X-ray shielding sheet 20, and an insulating layer 50. The soft X-ray generation device 90 generates soft X-rays 92 for ionizing air 102. The container 10 has an outlet 12 from which ionized air 100 that has been ionized by the soft X-rays 92 flows out. The soft X-ray shielding sheet 20 is used at the outlet 12 of the container 10 and includes a first outer sheet 30 that is formed of a material opaque to the soft X-rays 92, an interlayer sheet 34 that is formed of a material opaque to the soft X-rays 92, and a second outer sheet 40 that is formed of a material opaque to the soft X-rays 92. The first outer sheet 30 has supply ports 32 for the ionized air 100 formed therein. The interlayer sheet 34 has an ionized air passage 38 including ionized air inlet openings 36, which communicate with the supply ports 32, formed therein. The second outer sheet 40 has a discharge port 42, which communicates with the ionized air passage 38, formed therein. The first outer sheet 30, the interlayer sheet 34, and the second outer sheet 40 are stacked and adhered. The supply ports, the ionized air passage, and the discharge port communicate with each other to provide an ionized air transmission portion 44. The insulating layer 50 insulates the soft X-ray shielding sheet 20 and the container 10 from each other.

In this configuration, air can be ionized by soft X-rays, the soft X-rays can be shielded while allowing passage of the ionized air with the soft X-ray shielding sheet, and further the soft X-ray shielding sheet is insulated from the container. Thus, the ionized air is not trapped by the soft X-ray shielding sheet and the amount of ionized air discharged increases.

In a soft X-ray static electricity removal apparatus 1 according to a second aspect of the present invention, as illustrated in FIG. 3 for example, the ionized air passage 38 extending from the supply ports 32 to the discharge port 42 has a bent portion 39. In this configuration, the ionized air passage through which ionized air flows has the bent portions and this increases the number of times soft X-rays hit the ionized air passage during passing through the passage, thereby making the soft X-rays difficult to pass.

In a soft X-ray static electricity removal apparatus 1 according to a third aspect of the present invention, as illustrated in FIG. 1 for example, the insulating layer 50 is formed of ceramic. In this configuration, the insulating layer is formed of ceramic and this prevents deterioration due to soft X-rays.

In a soft X-ray static electricity removal apparatus 1 according to a fourth aspect of the present invention, as illustrated in FIG. 5 for example: the soft X-ray shielding sheet 20 has a circular cross section; and the insulating layer 50 has a plurality of arc-shaped ceramics 52 which are arranged so as to surround an outer periphery of the soft X-ray shielding sheet 20. In this configuration, the insulating layer has a plurality of arc-shaped ceramics and this prevents deterioration due to soft X-rays and prevents cracks at both the time of manufacture and the time of use.

A soft X-ray static electricity removal apparatus 1 according to a fifth aspect of the present invention further includes, as illustrated in FIG. 1 for example, a power supply device 60 that applies a potential difference to the container 10 and the soft X-ray shielding sheet 20. In this configuration, a potential difference can be applied to the container and the soft X-ray shielding sheet and this allows adjustment of the amount of positive ions/negative ions.

A soft X-ray static electricity removal apparatus 1 according to a sixth aspect of the present invention further includes, as illustrated in FIG. 1 and FIG. 5 for example, a casing 55 that holds the insulating layer 50 at the outlet 12 of the container 10 so as to have the insulating layer 50 and the soft X-ray shielding sheet 20 arranged at the outlet 12 and that has a gap 56 between itself and the soft X-ray shielding sheet 20. In this configuration, soft x-rays are prevented from leaking from between the casing and the soft X-ray shielding sheet.

According to the soft X-ray static electricity removal apparatus of the present invention, air can be ionized by soft X-rays, the soft X-rays can be shielded while allowing passage of the ionized air with the soft X-ray shielding sheet, and further the soft X-ray shielding sheet is insulated from the container. Thus, the amount of ionized air discharged can be increased. In addition, by applying a potential difference to the container and the soft X-ray shielding sheet, the amount of positive ions/negative ions discharged can be adjusted.

This application is based on Japanese Patent Application No. 2019-092937 filed on May 16, 2019 in Japan, the contents of which form part of the present application.

The present invention will also be more fully understood from the following detailed description. However, the detailed description and specific examples, while indicating preferred embodiments of the present invention, are given for illustrative purposes only. From this detailed description, various changes and modifications will be apparent to those skilled in the art.

The applicant does not intend to dedicate any described embodiments to the public, and to the extent any disclosed modifications or alterations may not literally fall within the scope of the claims, they are considered to be part hereof under the doctrine of equivalents.

The use of the terms "a" and "an" and "the" and similar referents in the context herein or the context of the claims are to be construed to cover both the singular and the plural, unless otherwise indicated herein or clearly contradicted by context. The use of any examples, or exemplary language (e.g., "such as") provided herein, is intended merely to better illustrate the present invention and does not pose a limitation on the scope of the invention unless otherwise claimed.

DESCRIPTION OF EMBODIMENT

Figure 1:
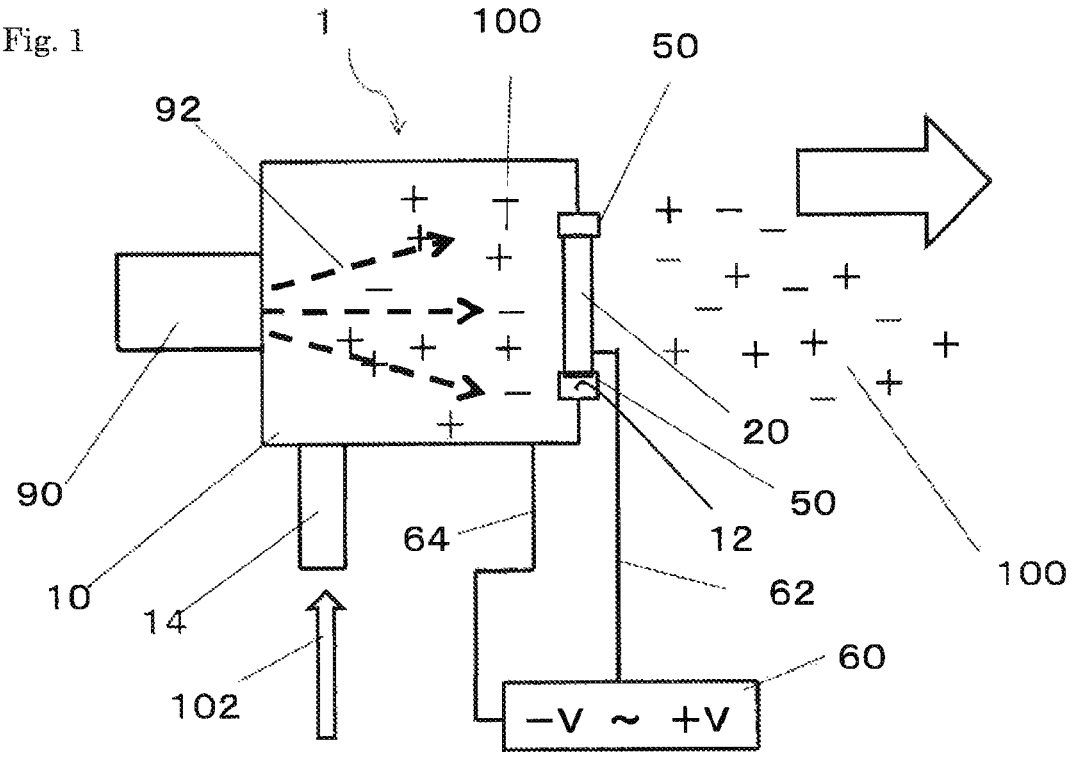
FIG. 1 is a conceptual diagram for illustrating a soft X-ray static electricity removal apparatus of the present invention.

Hereinafter, an embodiment of the present invention will be described with reference to drawings. It should be noted that in the drawings, the same or corresponding devices are denoted by the same reference numerals, thereby omitting redundant descriptions thereof. First, with reference to FIG. 1, a soft X-ray static electricity removal apparatus 1 of the present invention will be described.

The soft X-ray static electricity removal apparatus 1 includes a container 10 that provides a space in which air is ionized and through which ionized air 100, which has been ionized, flows. The container 10 has an air inlet 14 that takes air 102 into the container 10. The air inlet 14 may include a fan to forcibly take the air 102 outside the container 10 into the container 10. In the container 10, a soft X-ray generation device 90 is arranged near a position where the air inlet 14 is provided. Soft X-rays 92 are generated from the soft X-ray generation device 90 and air is irradiated therewith within the container 10; thereby the air is ionized. The soft X-ray generation device 90 may be a known soft X-ray device and thus, detailed description thereof is omitted. On the container 10, an outlet 12 for the ionized air 100 is formed at a position away from a position where the air inlet 14 is provided. By providing the soft X-ray generation device 90 near the air inlet 14 and providing the outlet 12 at a position away from the air inlet 14, air is caused to flow from the air inlet 14 to the outlet 12, the air can be ionized by the soft X-rays 92 from the soft X-ray generation device 90, and the ionized air 100 is discharged from the outlet in a short period of time. Thus, this arrangement is preferable; but other arrangements are acceptable. In general, the container 10 is formed by stainless steel or other metal.

At the outlet 12, a soft X-ray shielding sheet 20 is arranged. That is, the ionized air 100 is discharged from the container 10 by passing through the soft X-ray shielding sheet 20.

Figure 2:
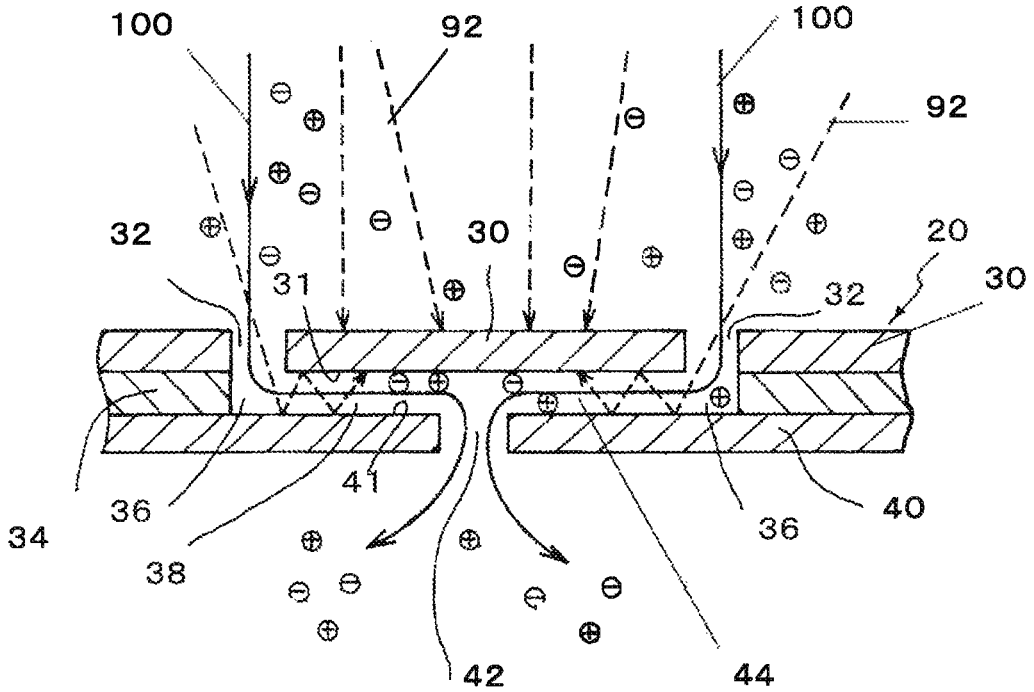
FIG. 2 is a cross-sectional view for illustrating an ionized air transmission portion of a soft X-ray shielding sheet used in the soft X-ray static electricity removal apparatus.
Figure 3:
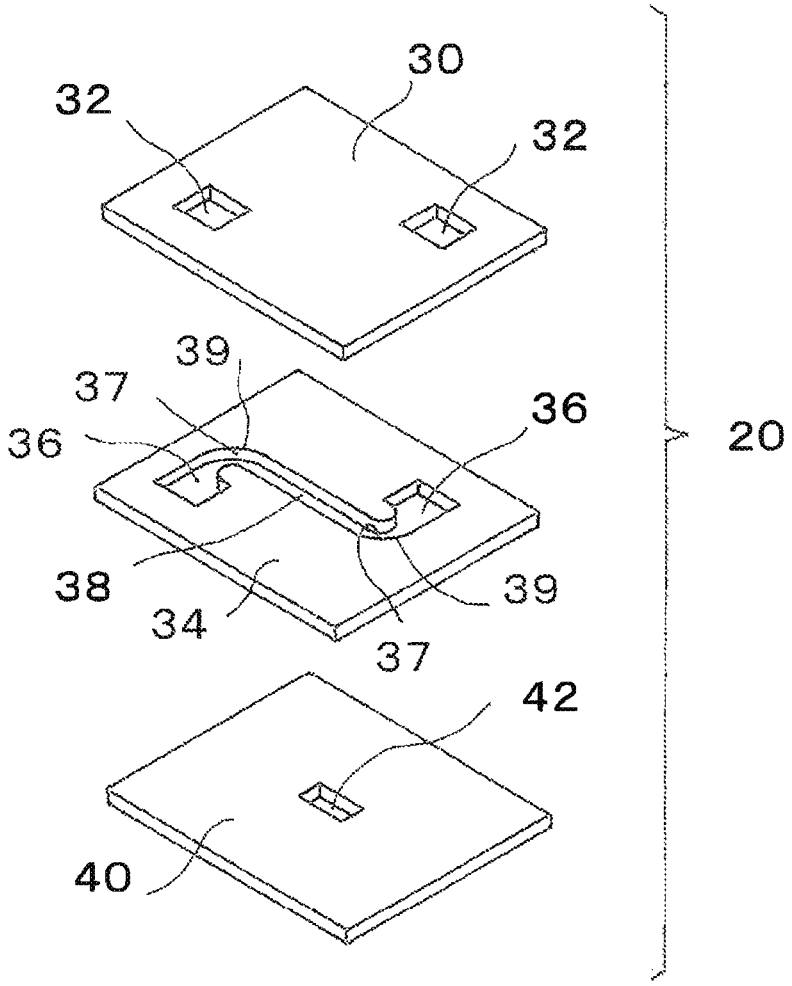
FIG. 3 is an exploded perspective view of the soft X-ray shielding sheet for illustrating the ionized air transmission portion of the soft X-ray shielding sheet used in the soft X-ray static electricity removal apparatus.

Here, with reference to FIG. 2 and FIG. 3, an ionized air transmission portion 44 of the soft X-ray shielding sheet 20 through which the ionized air 100 passes is described. FIG. 2 is a cross-sectional view in the vicinity of the ionized air transmission portion 44 of the soft X-ray shielding sheet 20; and FIG. 3 is an exploded perspective view thereof. The soft X-ray shielding sheet 20 is formed by stacking and adhering three sheets of a first outer sheet 30 that is formed of a material opaque to the soft X-rays 92, an interlayer sheet 34 that is formed of a material opaque to the soft X-rays 92, and a second outer sheet that is formed of a material opaque to the soft X-rays 92. Here, the material opaque to soft X-rays is typically a metal such as lead, iron, or aluminum, but is not limited to the metal. Metal can block the transmission of soft X-rays 92 even if it is thin and in addition, it is easily formed to be thin, so it is suitable for the soft X-ray shielding sheet 20. Furthermore, a method for stacking and adhering them is not particularly limited. In the first outer sheet 30, supply ports 32 through which the ionized air 100 in the container 10 enters the soft X-ray shielding sheet 20 are formed. In the interlayer sheet 34, an ionized air passage 38 that has an ionized air inlet opening 36 at both end parts thereof is formed. In the second outer sheet 40, a discharge port 42 through which the ionized air 100 is discharged to the outside of the container 10 is formed.

In the present example, two supply ports 32 in the first outer sheet 30 are formed so as to provide spacing between them on the first outer sheet 30. The ionized air passage 38 in the interlayer sheet 34 includes the ionized air inlet openings 36 which are respectively formed at positions where communication with the supply ports 32 in the first outer sheet 30 is performed; and is formed so as to communicate with each of the ionized air inlet openings 36. The discharge port 42 in the second outer sheet 40 is formed at a position where communication with the ionized air passage 38 is performed in the interlayer sheet 34.

By stacking and adhering the first outer sheet 30, the interlayer sheet 34, and the second outer sheet 40, which are formed as described above, the supply ports 32 in the first outer sheet 30 and the ionized air inlet openings 36 in the interlayer sheet 34 are made to communicate with each other, respectively and furthermore, at the center of the ionized air passage 38 in the interlayer sheet 34, the ionized air passage 38 and the discharge port 42 in the second outer sheet 40 communicate with each other; thereby forming an ionized air transmission portion 44. In the soft X-ray shielding sheet 20, one ionized air transmission portion 44 may be formed; however, a plurality of ionized air transmission portions 44 may be formed.

In the ionized air passage 38, bent portions 39 that bend at 90 degrees on a plane are provided so that the number of times the soft X-rays 92 hit an inner surface 41 of the second outer sheet 40 and an inner surface 31 of the first outer sheet 30 while entering from the supply ports 32 and reaching the discharge port 42 increases and the soft X-rays 92 are attenuated or disappear.

In addition, in order that a fluid resistance of the ionized air 100, which has been ionized, is controlled so as to allow the ionized air to reach the discharge port 42 in a short period of time and so as to prevent recombination of positive ions and negative ions, each of the bent portions 39 of the ionized air passage 38 is formed to have a curved face 37 that is to reduce the fluid resistance of the ionized air. That is, the ionized air passage 38 has at least one or more bent portions 39 that bend at 90 degrees on a plane and thereby allows the soft X-rays 92 to disappear due to its hit on an inner surface, that is, the passage. It should be noted that the shape of the ionized air passage 38 may be other shapes. The shape is preferably such that the fluid resistance of the ionized air 100 is controlled while the number of times the soft X-rays 92 hit the passage is increased.

The operation of the soft X-ray shielding sheet 20 which is used in the soft X-ray static electricity removal apparatus 1 of the present invention according to the above configuration will be described with reference to FIG. 2. In the container 10 that is on an upstream side of the soft X-ray shielding sheet 20, the ionized air 100 which has been ionized into positive ions and negative ions by the soft X-rays 92 is in a pressurized state which is caused by feeding the air 102 into the container 10. Therefore, the ionized air 100 flows from the supply ports 32 through the ionized air inlet openings 36 and the ionized air passage 38 and is discharged from the discharge port 42 to a downstream side of the soft X-ray shielding sheet 20.

The soft X-rays 92 are incident from each of the supply ports 32 and go straight, pass the ionized air passage 38 through the ionized air inlet openings 36, and reach the discharge port 42; during which as illustrated in FIG. 2, they hit the inner surface 41 of the second outer sheet 40, the inner surface 31 of the first outer sheet 30, the curved faces 37 of the bent portions 39, or the like, thereby preventing their travel in a straight line. By the hits on the inner surfaces 31 and 41, and the like, the soft X-rays 92 are attenuated and eventually almost disappear, so that the dangerous soft X-rays 92 are prevented from leaking from the discharge port 42. In order to make the soft X-rays 92 attenuated and almost disappear, it is preferable that there should be three times or more hits on the inner surfaces 31 and 41, and the like. For that purpose, the size and length of a cross section of the ionized air transmission portion 44 and the number of bent portions 39, that is, a path of the ionized air passage 38 and the like are designed. It should be noted that the number of sheets constituting the soft X-ray shielding sheet 20 may be not three but four or more.

The ionized air 100 introduced from the supply ports 32 passes through the ionized air passage 38 and reaches the discharge port 42. Since the bent portions 39 of the ionized air passage 38, which are provided from the viewpoint of preventing leakage of the soft X-rays 92, are formed to have the curved face 37, the fluid resistance is reduced, allowing the ionized air 100 to reach the discharge port 42 in a short period of time. In particular, it is preferable that the ionized air 100 should pass through the soft X-ray shielding sheet 20 in a short period of time so as to prevent recombination of positive ions and negative ions; and thus, the path of the ionized air transmission portion 44 is shortened. Therefore, a large amount of ions are discharged to a downstream side of the discharge port 42.

In the case of the soft X-ray shielding sheet 20 illustrated in FIG. 2 and FIG. 3, two supply ports 32 and one discharge port 42 are provided, where the ionized air 100 passes the ionized air passage 38 and two flows of it collide at the discharge port 42 and thereby, the ionized air 100 from the discharge port 42 can be made to blow out vertically.

Figure 7:
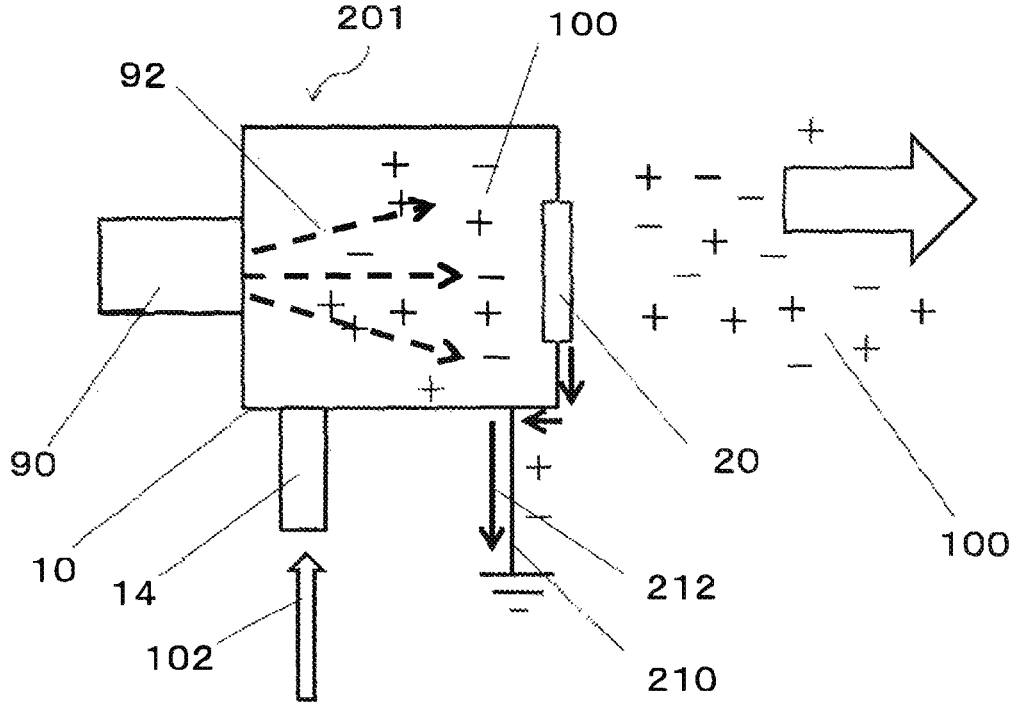
FIG. 7 is a conceptual diagram for illustrating a conventional soft X-ray static electricity removal apparatus.

However, as illustrated in FIG. 7, in a conventional soft X-ray static electricity removal apparatus 201, the container 10 and the soft X-ray shielding sheet 20 are conducted to each other. A grounding wire 210 is connected to the container 10 so that a potential 212 from the container 10 and the soft X-ray shielding sheet 20 is passed to the ground. For this reason, the ionized air 100 is trapped in the soft X-ray shielding sheet 20 and the amount of ionized air 100 that passes through the soft X-ray shielding sheet 20 is apt to decrease.

Figure 4:
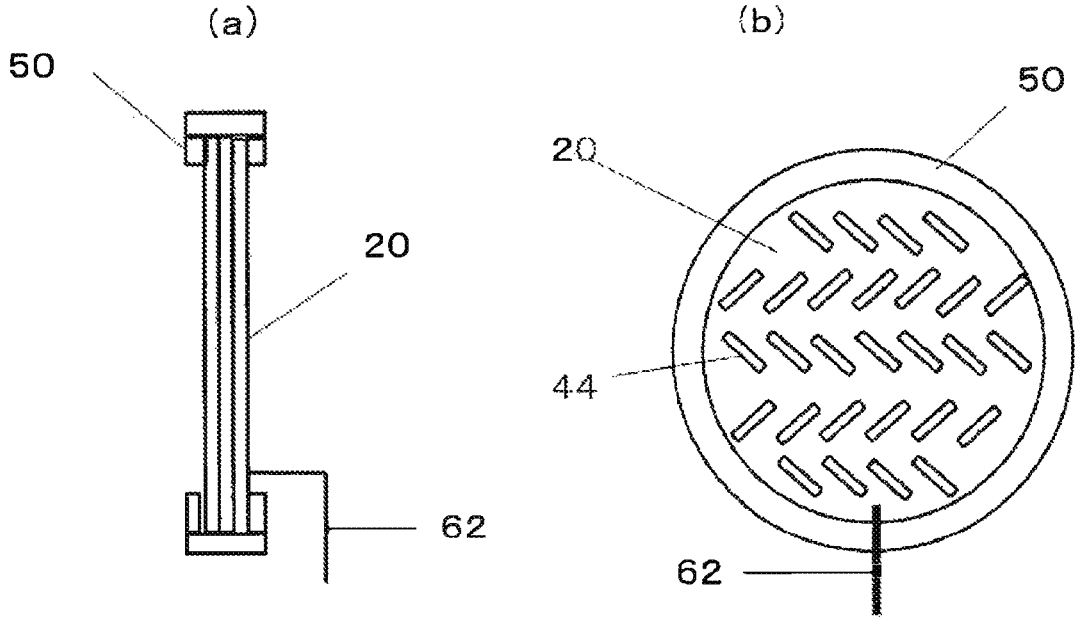
FIG. 4 is a diagram for illustrating the soft X-ray shielding sheet and an insulating layer, which are used in the soft X-ray static electricity removal apparatus; (a) is a cross-sectional view in a plane orthogonal to a flow direction of ionized air and (b) is a side view seen from the flow direction of the ionized air.

Then, as illustrated in FIG. 1 and FIG. 4, in the soft X-ray static electricity removal apparatus 1, the container 10 and the soft X-ray shielding sheet 20 are insulated from each other by the insulating layer 50. The soft X-ray shielding sheet 20 illustrated in FIG. 4 has a circular cross section and has a number of ionized air transmission portions 44 formed therein. On a circular outer periphery thereof, the insulating layer 50 is arranged.

Figure 5:
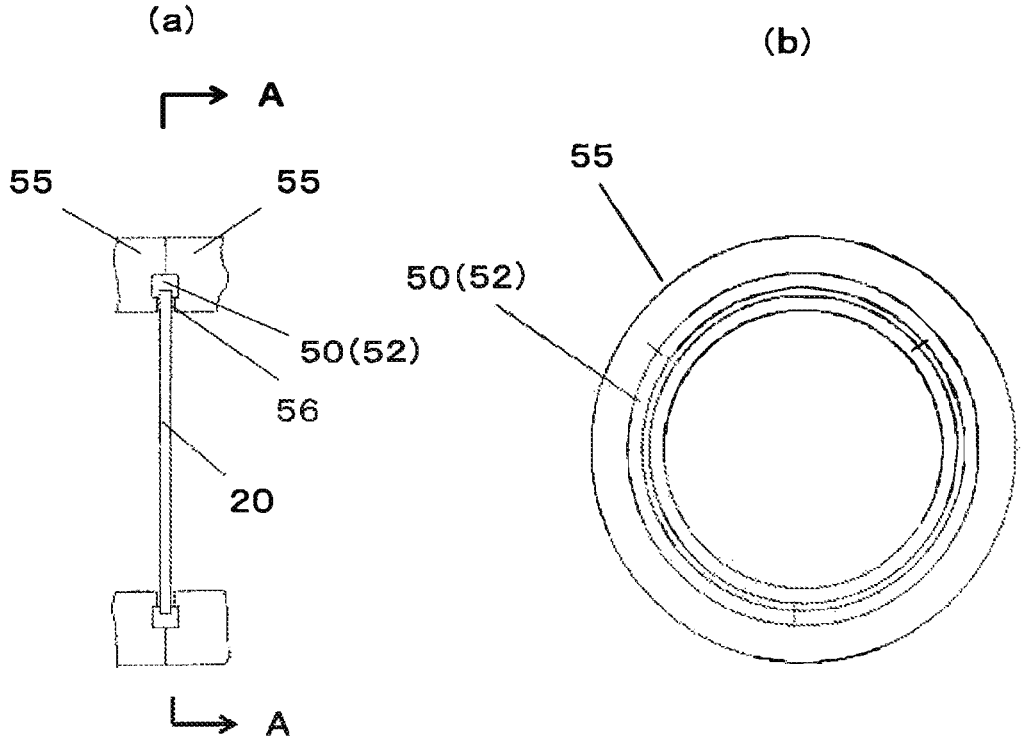
FIG. 5 is a diagram for illustrating an insulating layer of an embodiment; (a) is a cross-sectional view in a plane orthogonal to a flow direction of ionized air and (b) is a cross-sectional view on A-A.

FIG. 5 illustrates one example of the insulating layer 50. On the circular outer periphery of the soft X-ray shielding sheet 20, three arc-shaped ceramics 52 are arranged. Although there are insulating materials such as plastic and the like other than ceramic, they deteriorate by being irradiated with soft X-rays and generate powders. Ceramic does not deteriorate even when being irradiated with soft X-rays and is therefore preferable. In addition, an annular-shaped ceramic that covers the outer periphery of the soft X-ray shielding sheet 20 is acceptable; however, ceramic is a fragile material and therefore, may be broken at the time of manufacture or use. Therefore, instead of covering the entire perimeter with one annular-shaped member, a plurality of divided arc-shaped ceramics 52 are used. Furthermore, the soft X rays 92 pass through ceramic. Therefore, in order to prevent the soft X-rays 92 from passing through the annular-shaped insulating layer 50, which covers the outer periphery of the soft X-ray shielding sheet 20, and from leaking, the annular-shaped insulating layer 50 is covered by a casing 55 (see FIG. 6) of the soft X-ray shielding sheet 20. The casing 55 is commonly formed with the same material as that of the container 10, such as stainless steel. Here, the casing 55 is structured so as to cover the soft X-ray shielding sheet 20 with a narrow gap 56 (for example, a clearance of 0.5 mm and a radial-direction width of 2 mm). By this gap 56, the soft X-ray shielding sheet 20 and the casing 55 are insulated from each other. In addition, the gap 56 is made narrow and long, that is, the width in a radial direction is made larger than the clearance; and thereby, the soft X-rays 92 are prevented from passing through a space between the soft X-ray shielding sheet 20 and the casing 55. More specifically, the gap 56 is shaped so that, when the soft X-rays 92 pass through the gap 56, they hit the soft X-ray shielding sheet 20 and the casing 55 three times or more. Thus, the soft X-rays 92 are prevented from traveling in a straight line and hit the casing 55 and around the outer periphery of the soft X-ray shielding sheet 20, thereby being attenuated and disappearing. The casing 55 of the soft X-ray shielding sheet 20 preferably, as illustrated in FIG. 5 (*a*), is a circular ring having a cross section of a U shape and is configured to store the arc-shaped ceramics 52 within the U shape, which facilitates handling the insulating layer 50. In FIG. 5, the arc-shaped ceramics 52 obtained by dividing its circumference into three equal parts are used; however, the number thereof is freely selected.

The container 10 and the soft X-ray shielding sheet 20 are insulated from each other by the insulating layer 50 and thereby when ions are trapped in the soft X-ray shielding sheet 20 in an initial stage of operation, the soft X-ray shielding sheet 20 gets the potential of trapped ions (positive or negative) and thereafter, ions of the same potential are not trapped and are transmitted through the soft X-ray shielding sheet 20. Therefore, the ionized air 100 that is discharged through the soft X-ray shielding sheet 20 increases.

Furthermore, since insulation is made with the insulating layer 50, a potential difference can be applied to the container 10 and the soft X-ray shielding sheet 20. As illustrated in FIG. 1, a power supply device 60 is provided, the positive or negative electrode of which is connected to the soft X-ray shielding sheet 20 with a soft X-ray shielding sheet cable 62, and the other electrode of which is connected to the container 10 with a container cable 64. Then, the soft X-ray shielding sheet 20 is positively or negatively charged and the container 10 is charged with a positive or negative voltage that is opposite thereto. It is estimated that when the container 10 is charged, dispersion of the ions of the same polarity in the container 10 (positive ions when positively charged, or negative ions when negatively charged) decreases, the ions of the same polarity in the container 10 increase, and the ions of the same polarity that pass through the soft X-ray shielding sheet 20 increase. That is, the amount of positive/negative ions discharge can be adjusted. Since the container 10 and the soft X-ray shielding sheet 20 are small and a potential to be applied may be low, a current flowing from the power supply device 60 may be as extremely small as several nA to several pA and the power supply device 60 may be a battery with low power.

As described so far, according to the soft X-ray static electricity removal apparatus 1 of the present invention, the soft X-ray shielding sheet 20 is insulated and thereby the amount of ionized air 100 discharged can be increased. In addition, a potential difference is applied to the container 10 and the soft X-ray shielding sheet 20 and thereby, the amount of positive/negative ions discharged can be adjusted.

Example 1

Figure 6:
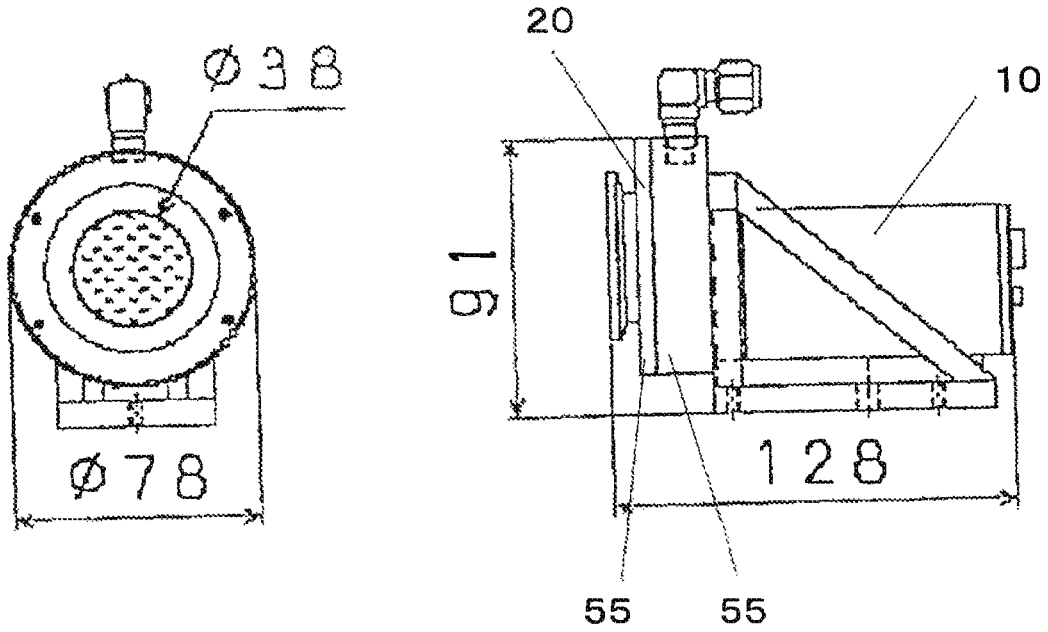
FIG. 6 is a diagram illustrating a soft X-ray static electricity removal apparatus used for experimenting with effects of an insulating layer of the soft X-ray static electricity removal apparatus.

Here, an experiment for confirming the effects of the insulating layer of the soft X-ray static electricity removal apparatus is described. Here, the effects of the insulating layer were confirmed by measuring the time taken to remove static electricity from a charge plate by using a soft X-ray static electricity removal apparatus with an insulating layer and a soft X-rays static electricity removal apparatus without an insulating layer. The soft X-ray static electricity removal apparatus used in the experiment is C-IGB-CA-100434 manufactured by Kondoh Industries, Ltd. and its outer shape is illustrated in FIG. 6. The charge plate is H0601 manufactured by Shishido electrostatic, Ltd. and the dimensions of the plate are 150 mm×150 mm. While the distance from the discharge port of the soft X-ray static electricity removal apparatus to the charge plate was changed to 50, 100, 150, and 200 mm and the flowrate of air was changed to 20, 30, and 40 L/min, the time for removing static electricity from +1000 V to +100 V and the time for removing static electricity from −1000 V to −100 V were measured in accordance with JIS C61340-4-7 "charge plate." The results are shown in Table 1.

TABLE 1

| | | +1000 V→+100 V | | −1000 V→−100 V | |
|---|---|---|---|---|---|
| Air flowrate | Distance | Without insulating layer | With insulating layer | Without insulating layer | With insulating layer |
| 20 L/min | 50 mm | 8.3 sec | 8.4 sec | 8.1 sec | 8.0 sec |
| | 100 mm | 18.6 sec | 16.4 sec | 18.7 sec | 17.1 sec |
| | 150 mm | *** | 59.1 sec | 78.6 sec | 99.9 sec |
| | 200 mm | *** | *** | *** | *** |
| 30 L/min | 50 mm | 5.6 sec | 5.5 sec | 5.4 sec | 5.1 sec |
| | 100 mm | 9.7 sec | 8.9 sec | 9.6 sec | 8.5 sec |
| | 150 mm | 25.0 sec | 15.0 sec | 25.9 sec | 13.5 sec |
| | 200 mm | 115.2 sec | 33.3 sec | *** | 38.8 sec |
| 40 L/min | 50 mm | 4.3 sec | 4.0 sec | 4.1 sec | 3.8 sec |
| | 100 mm | 7.1 sec | 6.2 sec | 6.9 sec | 6.1 sec |
| | 150 mm | 12.4 sec | 9.3 sec | 12.3 sec | 8.6 sec |
| | 200 mm | 30.6 sec | 14.3 sec | 46.2 sec | 15.6 sec |

The results shown in Table 1 are averages of three actual measurements. Items indicated by "***" in Table 1 indicate results that static electricity was not removed (not lowered to 100 V) after 200 seconds had passed.

As is obvious from the results in Table 1, it was found that by providing an insulating layer, the static electricity removal time is shortened except with some exceptions. Especially, in the case where the static electricity removal time was long without an insulating layer at the distance of 150 mm or 200 mm, the static electricity removal time was significantly shortened. This is considered to be a result of discharging a large amount of ionized air and thereby removing static electricity from the charge plate.

Example 2

Next, described will be an experiment in which it was confirmed that the amount of positive/negative ions discharged can be adjusted by applying a potential difference to the container 10 and the soft X-ray shielding sheet 20 (see FIG. 1). By using the same soft X-ray static electricity removal apparatus (with an insulating layer) as used in the Example 1, a potential difference was applied to the container 10 and the soft X-ray shielding sheet 20 and the time for removing static electricity from the charge plate was measured. The distance from the discharge port of the soft X-ray static electricity removal apparatus to the charge plate was set to 200 mm and the flowrate of air was set to 30 L/min; and then, the static electricity removal time in the cases of setting the potential differences between the soft X-ray shielding sheet 20 and the container 10 to ±0 V, +10 V, and −10 V was measured. The results are shown in Table 2.

TABLE 2

| Potential difference applied | +1000 V→+100 V | −1000 V→−100 V |
|---|---|---|
| ±0 V | 23.1 sec | 19.5 sec |
| +10 V to soft X-ray shielding sheet (−10 V to container) | 19.9 sec | 23.4 sec |
| −10 V to soft X-ray shielding sheet (+10 V to container) | 26.4 sec | 16.3 sec |

The results shown in Table 2 are averages of three actual measurements. A difference in the results in the voltage applied of ±0 V from those in Table 1 is estimated to be because measurement dates were different and the static electricity removal time, which is greatly influenced by atmospheric conditions (humidity, temperature, and the like), was changed due to the influence of a different atmosphere.

When a potential difference of +10 V was applied to the soft X-ray shielding sheet (conversely, −10 V to the container), the time for removing a positive voltage became short in comparison with a case where the potential difference was not applied, that is, the discharge of negative ions increased; and the time for removing a negative voltage became long, that is, the discharge of positive ions decreased. In addition, when a potential difference of −10 V was applied to the soft X-ray shielding sheet (conversely, +10 V to the container), the time for removing a positive voltage became long in comparison with a case where the potential difference was not applied, that is, the discharge of negative ions decreased; and the time for removing a negative voltage became short, that is, the discharge of positive ions increased. In short, when a positive voltage was applied to the soft X-ray shielding sheet and a negative voltage was applied to the container, dispersion of negative ions on an inner wall of the container decreased and negative ions in the container increased. As a result, it is estimated that the amount of negative ions discharged increased and the time for removing a positive voltage became short. Conversely, it is estimated that when a negative voltage and a positive voltage were applied to the soft X-ray shielding sheet and the container, respectively, positive ions in the container increased and thereby the amount of positive ions discharged increased and the time for removing a negative voltage became short.

As is also obvious from Table 2, by applying a potential difference to the container and the soft X-ray shielding sheet, the amount of positive/negative ions discharged can be adjusted.

The main reference numerals used in the description and drawings are listed below.

1 soft X-ray static electricity removal apparatus
10 container
12 outlet
20 soft X-ray shielding sheet
30 first outer sheet
31 inner surface of first outer sheet
32 supply port
34 interlayer sheet
36 ionized air inlet opening
37 curved face
38 ionized air passage
39 bent portion
40 second outer sheet
41 inner surface of second outer sheet
42 discharge port
44 ionized air transmission portion
50 insulating layer
52 arc-shaped ceramic
54 soft X-ray shielding plate
55 casing of soft X-ray shielding sheet
56 gap
60 power supply device
90 soft X-ray generation device
92 soft X-ray
100 ionized air
102 air
201 conventional soft X-ray static electricity removal apparatus
210 grounding wire
212 potential (flow thereof)

The invention claimed is:

1. A soft X-ray static electricity removal apparatus comprising:

a soft X-ray generation device that generates soft X-rays for ionizing air;

a container having an outlet, ionized air flowing out from the outlet, the ionized air having been ionized with the soft X-rays;

a soft X-ray shielding sheet that is used at the outlet of the container and includes:

a first outer sheet formed of a material opaque to the soft X-rays;

an interlayer sheet formed of a material opaque to the soft X-rays; and a second outer sheet formed of a material opaque to the soft X-rays;

wherein the first outer sheet has a supply port for the ionized air formed therein;

the interlayer sheet has an ionized air passage formed therein, the ionized air passage having an ionized air inlet opening, the ionized air inlet opening communicating with the supply port; and the second outer sheet having a discharge port formed therein, the discharge port communicating with the ionized air passage;

and wherein the first outer sheet, the interlayer sheet, and the second outer sheet are stacked and adhered, and the supply port, the ionized air passage, and the discharge port communicate with each other to provide an ionized air transmission portion; and an insulating layer that insulates the soft X-ray shielding sheet and the container from each other.

2. The soft X-ray static electricity removal apparatus of claim 1, wherein the ionized air passage extending from the supply port to the discharge port has a bent portion.

3. The soft X-ray static electricity removal apparatus of claim 1, wherein the insulating layer is formed of ceramic.

4. The soft X-ray static electricity removal apparatus of claim 3, wherein the soft X-ray shielding sheet has a circular cross section, and the insulating layer has a plurality of arc-shaped ceramics, the ceramics being arranged so as to surround an outer periphery of the soft X-ray shielding sheet.

5. The soft X-ray static electricity removal apparatus of claim 1, further comprising:

a power supply device that applies a potential difference to the container and the soft X-ray shielding sheet.

6. The soft X-ray static electricity removal apparatus of claim 1, further comprising:

a casing that holds the insulating layer at the outlet of the container so as to have the insulating layer and the soft X-ray shielding sheet arranged at the outlet, the casing having a gap between itself and the soft X-ray shielding sheet.

* * * * *